US008323159B2

(12) United States Patent
Perry et al.

(10) Patent No.: US 8,323,159 B2
(45) Date of Patent: Dec. 4, 2012

(54) SYSTEM AND APPARATUS FOR STORAGE AND USE OF DUMBBELLS

(75) Inventors: David A. Perry, New York, NY (US); Paul M. Picciano, Windham, NH (US)

(73) Assignee: Mesacor, Inc., New York, NY (US)

( * ) Notice: Subject to any disclaimer, the term of this patent is extended or adjusted under 35 U.S.C. 154(b) by 40 days.

(21) Appl. No.: 12/319,923

(22) Filed: Jan. 14, 2009

(65) Prior Publication Data

US 2010/0179032 A1 Jul. 15, 2010

(51) Int. Cl.
*A63B 21/072* (2006.01)

(52) U.S. Cl. ..... 482/108; 482/94

(58) Field of Classification Search ..... 482/92–94, 482/97, 98, 104, 106–108, 148, 51; D21/681, D21/686; D6/552
See application file for complete search history.

(56) References Cited

U.S. PATENT DOCUMENTS

| | | | | |
|---|---|---|---|---|
| D424,141 | S * | 5/2000 | Eckmann | D21/686 |
| D455,310 | S * | 4/2002 | Webber | D6/552 |
| D469,293 | S * | 1/2003 | Harms | D6/552 |
| D469,294 | S * | 1/2003 | Harms et al. | D6/552 |
| 7,022,053 | B2 * | 4/2006 | Whetstone | 482/104 |
| 7,029,425 | B2 * | 4/2006 | Krull | 482/94 |
| D528,612 | S * | 9/2006 | Black | D21/686 |
| 7,112,163 | B2 * | 9/2006 | Krull | 482/104 |
| D565,132 | S * | 3/2008 | Lien et al. | D21/686 |
| D603,637 | S * | 11/2009 | Anderson et al. | D6/552 |
| 7,837,601 | B2 * | 11/2010 | Perry et al. | 482/94 |
| 2005/0009671 | A1 * | 1/2005 | Hummer | 482/94 |
| 2007/0049472 | A1 * | 3/2007 | Hummer | 482/104 |
| 2007/0099773 | A1 * | 5/2007 | Hummer | 482/104 |
| 2009/0211996 | A1 * | 8/2009 | Webber et al. | 211/85.7 |
| 2011/0070569 | A1 * | 3/2011 | Martens | 434/247 |

FOREIGN PATENT DOCUMENTS

WO WO 2006069421 A1 * 7/2006

OTHER PUBLICATIONS

Chaffin, Don B. ; Primary Prevention of Low Back Pain Through the Application of Biochanics in Manual Handling Tasks; G. Ital Med Lav Eng 2005; 27:1: pp. 40-50.

Chaffin, Don B; A Biomechanical Basis for Low Back Injury Risk in High Exertion Tasks; Proceedings of the Human Factors and Erognomics Society 49$^{th}$ Annual Meeting—2005; pp. 1344-1348.

(Continued)

*Primary Examiner* — Seve R Crow
*Assistant Examiner* — Victor K Hwang
(74) *Attorney, Agent, or Firm* — Tod R. Nissle, P.C.

(57) ABSTRACT

An apparatus to store and facilitate the safe simultaneous use of dumbbells by multiple individuals. The apparatus includes first and second staging stations. The first staging station includes a first side, a second side, and first and second spaced apart towers. An individual can walk from the first side of the staging station to a position between the first and second towers with the individual's entire body in a space intermediate the towers. The second staging station includes a primary side, a secondary side, and spaced apart third tower and fourth towers. The second staging station is positioned normal to the first staging station such that a first individual in the first staging station can grasp dumbbells on an outwardly facing tier of the fourth tower of the second staging station at the same time a second individual is standing between the third and fourth towers of the second staging station.

1 Claim, 6 Drawing Sheets

OTHER PUBLICATIONS

Gallagher, S and Mayton, G; Back injury control measures for manual lifting and seat design; NIOSH, Pittsburgh, PA.

Kerk, Carter J.; Applied Science and Engineering: Work Physiology; Section 2 Ergonomic Hazards and Repetitive Strain Injuries; pp. 1-8.

Keir, Peter J., Bach, Joel M., Hudes, Mark, Rempel, David M.; Guidelines for Wrist Posture Based on Carpal Tunnel Pressure Thresholds; Human Factors, vol. 49, No. 1, Feb. 2007, pp. 88-99.

NIOSH, pp. 1-35.

Perry et. al.; Biochanical Analysis; pp. 1-4.

* cited by examiner

SYSTEM AND APPARATUS FOR STORAGE AND USE OF DUMBBELLS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH OR DEVELOPMENT:

Not Applicable.

INCORPORATION-BY-REFERENCE OF MATERIAL SUBMITTED ON A COMPACT DISC

Not Applicable.

BACKGROUND OF THE INVENTION (1) Field of the Invention.

This invention relates to exercise equipment and methodology.

More particularly, the invention relates to apparatus for storing and using dumbbells.

(2) Description of Related Art including information disclosed under 37 CFR 1.97 and 1.98.

Racks for storing dumbbells are well known in the art. However, as has been demonstrated many times in the Patent Office, existing apparatus and methods often can be improved by utilizing an unidentified, unanticipated combination which provides functions that are unpredictable in view of the prior art.

Accordingly, it would be highly desirable to provide an improved system to store and utilize dumbbells.

Therefore, it is a principal object of the invention to provide an improved system to store and utilize dumbbells.

BRIEF DESCRIPTION OF THE SEVERAL VIEWS OF THE DRAWINGS

These and other, further and more specific objects and advantages of the invention are set forth below, in conjunction with the drawings, in which.

BRIEF SUMMARY OF THE INVENTION

Figure 1:
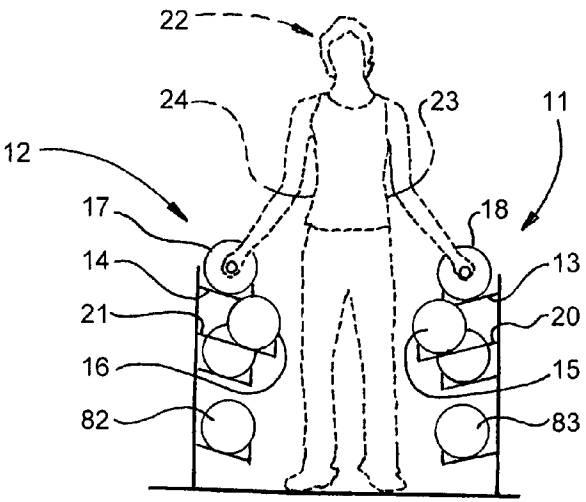
FIG. 1 is a front view illustrating a dumbbell rack system constructed in accordance with the invention.

Briefly, in accordance with the invention, we provide an improved method for an individual to prepare for and conduct an exercise using dumbbells while minimizing the risk of injury during the acquisition, use, and return of the dumbbells. The individual has a power zone, first and second sides, and a pair of hands. The method includes the step of providing a staging station. The staging station comprises a first side; a second side; a first tower including at least first and second generally horizontally oriented spaced apart support tiers, the first tier at a first elevation, the second tier at a second elevation different from the first elevation; a second tower including at least third and fourth generally horizontally oriented spaced apart support tiers, the third tier at said first elevation, the fourth tier at said second elevation, the second tower spaced apart from the first tower such that an individual can enter from the first side of the staging station, walk between the towers, and exit on the second side of the staging station; and, a plurality of dumbbells. The dumbbells each have a center of gravity; include a first pair of dumbbells of equivalent shape, dimension, and weight, each of said pair mounted on a different one of the first and third support tiers such that the center of gravity of each of the dumbbells mounted on the first and third tiers is at an elevation above the ground in the power zone of the individual, and the first pair of dumbbells are generally parallel to one another; and, include a second pair of dumbbells of equivalent shape, dimension, and weight, each of the second pair mounted on a different one of the second and fourth support tiers such that the second pair of dumbbells are generally parallel to one another. The improved method also includes the steps of entering from the first side of the staging station and walking between the first and second towers such that the individual is between the first pair of dumbbells and each of the individual's first and second sides is parallel to the first pair of dumbbells; grasping each of the first pair of dumbbells with one of the individual's hands and lifting the first pair of dumbbells off the first and third tiers; walking out from between the first and second towers and exiting at the second side of the staging station; and, utilizing the first pair of dumbbells to perform an exercise.

In another embodiment of the invention, we provide an improved method for first and second individuals to prepare for and conduct an exercise simultaneously using dumbbells while minimizing the risk of injury during the acquisition, use, and return of the dumbbells. Each of the individuals has a power zone; first and second sides; and, a pair of hands. The improved method includes the step of providing a first staging station including a first side; a second side; a first tower including at least first and second generally horizontally oriented spaced apart support tiers, the first tier at a first elevation in an inward orientation, the second tier at a second elevation different from the first elevation and in an inward orientation; and, a second tower. The second tower includes at least third and fourth generally horizontally inwardly oriented spaced apart support tiers. The third tier is at the first elevation in an inward orientation. The fourth tier is at the second elevation in an inward orientation. The second tower is spaced apart from the first tower such that an individual can walk from the first side to a position between the first and second towers with the individual's entire body in a space intermediate said first and second towers; can, while intermediate the first and second towers, access the first and third tiers; and walk out from between the first and second towers to the second side of the first staging station. The first staging station also includes a plurality of dumbbells. The dumbbells each have a center of gravity; include a first pair of dumbbells of equivalent shape, dimension, and weight, each of the first pair mounted on a different one of said first and third support tiers such that the center of gravity of each of the dumbbells mounted on the first and third tiers is at an elevation above the ground in the power zone of each individual, and the first pair of dumbbells are generally parallel to one another. The dumbbells also include a second pair of dumbbells of equivalent shape, dimension, and weight. Each of said second pair are mounted on the second tier adjacent one another. The improved method also includes the step of providing a second staging station. The second staging station includes a first side; a second side; a third tower including at least fifth and sixth generally horizontally oriented spaced apart support tiers. The fifth tier is at a first elevation in an inward orientation. The sixth tier is at a second elevation different from the first elevation and in an outward orientation. The second staging station also includes a fourth tower including at least a seventh generally horizontally inwardly oriented spaced apart support tier. The seventh tier is at the first elevation in an inward orientation. The third tower is spaced apart from the fourth tower such that an individual can walk from the first side of the second staging station to a position between said third and fourth towers with the individual's entire body in a space intermediate said third and fourth towers; can access the fifth and seventh tiers; and, can walk out from between the third and fourth towers to the second side of the second staging station. The sixth tier is accessible by an individual standing on the first side of the second staging station. The second staging station also includes a plurality of dumbbells. The dumbbells of the second staging station each have a center of gravity; and, include a third pair of dumbbells of equivalent shape, dimension, and weight. Each of the third pair of dumbbells is mounted on a different one of the fifth and seventh support tiers such that the center of gravity of each of the dumbbells mounted on said fifth and seventh tiers is at an elevation above the ground in the power zone of the individual, and such that the third pair of dumbbells are generally parallel to one another. The dumbbells of the second staging station also include a fourth pair of dumbbells of equivalent shape, dimension, and weight. Each of the fourth pair is mounted on the sixth tier adjacent one another. The improved method also includes the steps of positioning the second staging station normal to the first staging station on the second side of the first staging station such that the sixth tier is accessible to an individual standing in the first staging station between the first and third tiers; having a first individual walk from the first side of the first staging station into the first staging station between the first and third tiers and grasp the fourth pair of dumbbells; and, simultaneously with the first individual walking into the first staging station, having a second individual walk into the second staging station and grasp the third set of dumbbells, and walk out of the second staging station.

In a further embodiment of the invention, we provide an improved method for an individual to prepare for and conduct an exercise using dumbbells while minimizing the risk of injury during the acquisition, use, and return of the dumbbells. The individual has a power zone; first and second sides; and, a pair of hands. The method includes the steps of providing a staging station. The staging station includes a first side; a second side; a first tower including at least first and second fixed generally horizontally oriented spaced apart support tiers, the first tier at a first elevation, the second tier at a second elevation different from the first elevation; a second tower including at least third and fourth generally horizontally oriented spaced apart support tiers, the third tier at the first elevation, the fourth tier at the second elevation, the second tower spaced apart from the first tower such that an individual can enter from the first side of the staging station, walk between the towers, and exit at the second side of the staging station; at least one dumbbell stand on the first fixed tier and shaped and dimensioned to receive a dumbbell and rotate about a vertical axis simultaneously with the dumbbell; and, a plurality of dumbbells. The dumbbells each have a center of gravity; and, include a first pair of dumbbells of equivalent shape, dimension, and weight. Each of the first pair of dumbbells is mounted on a different one of the first and third support tiers such that the center of gravity of each of the dumbbells mounted on the first and third tiers is at an elevation above the ground in the power zone of the individual; and, such that the first pair of dumbbells are generally parallel to one another. The dumbbells in the staging station also include a second pair of dumbbells of equivalent shape, dimension, and weight. Each of the second pair of dumbbells is mounted on a different one of the second and fourth support tiers such that the second pair of dumbbells is generally parallel to one another. One of the dumbbells in the staging station is mounted on the stand on the fixed first tier. The improved method also includes the steps of entering from the first side of the staging station and walking between the first and second towers such that the individual's entire body is between the first pair of dumbbells and each of the individual's first and second sides is parallel to the first pair of dumbbells; grasping each of the first pair of dumbbells with one of the individual's hands, rotating the one of the dumbbells and the stand about a vertical axis, and lifting the first pair of dumbbells off the first and third tiers; exiting out from between the first and second towers by walking out the second side of the staging station; and, utilizing the first pair of dumbbells to perform an exercise.

DETAILED DESCRIPTION OF THE INVENTION

Figure 2:
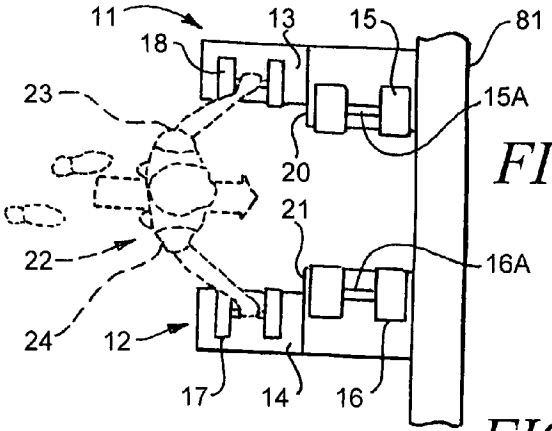
FIG. 2 is a top illustrating the dumbbell rack system of FIG. 1.
Figure 3:
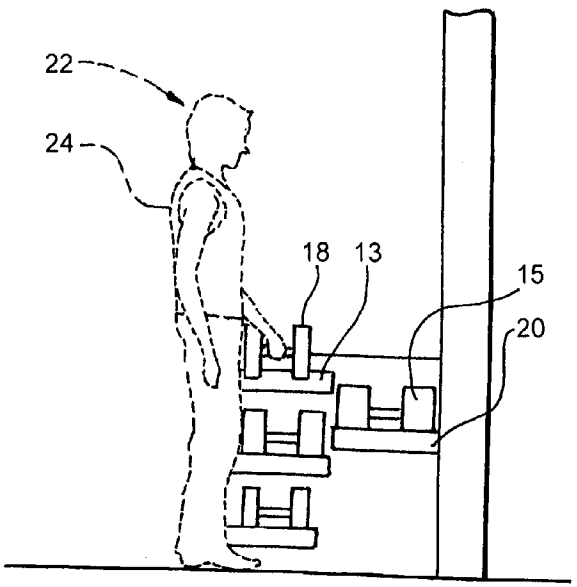
FIG. 3 is a side view illustrating the dumbbell rack system of FIG. 1.

Turning now to the drawings, which are presented by way of explanation and not limitation of the invention, and in which like reference characters refer to corresponding elements throughout the several views, FIGS. 1 to 3 illustrate a staging station including a pair of spaced apart towers 11 and 12 including support tiers 13, 14, 20, and 21. Spaced apart tiers 13 and 14 are each at the same elevation, or height above the ground. Spaced apart tiers 20 and 21 are each at the same elevation. The elevation of tiers 13 ad 14 is greater than that of tiers 20 and 21. Dumbbells 17 and 18 are removably mounted on tiers 14 and 13, respectively. Dumbbells 15 and 16 are removably mounted on tiers 20 and 21, respectively. Dumbbell 17 is equivalent in weight and shape and dimension to dumbbell 18.

Dumbbell 15 is equivalent in weight and shape and dimension to dumbbell 16. Dumbbells 15 and 16 are the heaviest dumbbells in the staging station and are placed on the support tiers 20 and 21 that are positioned at the optimum height to reduce the risk of injury to an individual 22 utilizing the staging station. Dumbbells 15 and 16 are, when the hands of individual 22 are in the neutral position, positioned adjacent the hands to facilitate removal of dumbbells 15 and 16 from the staging station. Tiers 20 and 21 position the dumbbells 15, 16 in the power zone of most individuals of average height and weight so that when an individual 22 walks into and stands upright in the staging station in the manner illustrated in FIGS. 1 to 3 with his or her arms hanging loosely at his or her side 23 or 24, the individual's hands typically are each located at an elevation above the ground that is equivalent to or within a few inches above or below the bars 15A, 16A of dumbbells 15, 16 that the individual grasps with his hand to lift dumbbell 15, 16 off its respective tier 20, 21. Individual 22 has, as noted, a first side 23 and a second side 24 that is spaced apart from and generally parallel to first side 23. In FIGS. 1 to 3, sides 23, 24 of individual 22 are generally parallel to dumbbells 15, 16, 17, 18.

In use of the staging station of FIGS. 1 to 3, an individual walks into the staging station with his or her arms hanging loosely at his or her sides, stands with his or her sides 23 and 24 generally parallel to the dumbbells in the manner illustrated in FIGS. 1 to 3, and stands with his or her hands beside the bars of the matched (i.e., in weight and shape and dimension) pair of dumbbells 15, 16, 17, 18 that the individual wishes to utilize. The individual then grasps the bar of each dumbbell with a different hand, lifts the dumbbells off their respective support tiers, and leaves the staging station. The individual 22 can walk forwardly into the staging station or can back into the staging station so the individual can, when leaving the staging station, back out of the staging station or walk forwardly out of the staging station, respectively. If individual 22 wishes to remove dumbbells that are located on support tiers that are below tiers 13 and 14, the individual must bend his or her knees (preferably with the individual's back substantially erect) and squat to reach the dumbbells.

FIGS. 2 and 3 illustrate an individual 22 standing in the staging station and reaching slightly forward to grasp a dumbbell. While this procedure is practiced by some individuals, it is preferred that before an individual 22 grasps a dumbbell that is on a support tier in the staging station, the individual be standing with his hands adjacent the desired dumbbells such that the individual need not reach forward to grasp the dumbbells but only need to move his hands a short distance outwardly away from his sides (and not forwardly or rearwardly from his sides) to grasp and lift the dumbbells upwardly off their respective support tiers.

If desired, each tier 13, 14, 20, 21 in the staging station can be supplied with a saddle unit that facilitates lifting a dumbbell upwardly from the tier or that facilitates rotating the dumbbell about a vertical axis that generally is perpendicular to the ground or to the tier, or both. The saddle unit can be constructed as desired and can, for example, be integrally formed with a tier 13, be permanently attached to a tier 13, or can simply removably rest on a tier 13. In one embodiment of a saddle unit constructed in accordance with the invention, a tier is provided with a smooth, low friction surface that permits a dumbbell to be easily turned about a generally vertically oriented axis while the lower portions of the cylindrical weights on the dumbbells continue to contact and slide over the low friction surface. The ability to turn a dumbbell on a support tier enables a user to position the dumbbell as such to achieve neutral postures of the upper extremities, particularly the wrist, before removing the dumbbell from the support tier. The wrist is in a neutral position when it is not bent and the back of the hand is in alignment with the back of the wrist such that the back of the hand and back of the wrist generally lie in the same plane.

Another possible saddle unit 30 is illustrated in FIGS. 4 to 7. The uppermost panel member, or "saddle", 25 of unit 30 includes concave detents or grooves 26, 27 shaped such that a portion of the cylindrical ends of a dumbbell each conform to and seat in a different one of grooves 26, 27. Arcuate slots 22A, 23A are formed in and extend through a fixed support tier 21A (e.g., or support tier 13, 14, 20, etc.), each slidably receive a hollow leg 27A and 26A, respectively, and permit saddle unit 40 to be pivoted with respect to tier 21A in the manner indicated by arrows A and B in FIG. 4. When unit 30 and, consequently, legs 27A and 26A, pivot in the directions of arrows A and B, the legs slide along slots 22A and 23A. When lower portions of the cylindrical ends of a dumbbell are each removably seated in and engage one of grooves 26 and 27 and a user grasps and rotates or pivots the bar of each dumbbell such that the ends of the dumbbell move in the directions indicated by arrows A and B, the user simultaneously rotates the dumbbell, panel member 25, legs 26A and 27A, base 33, feet 29 and 32 fixedly attached to base 33, and springs 31 and 35. Such pivoting enables a user to rotate a dumbbell (along with the noted portions of saddle unit 30) to a more ergonomic, customized position accommodating the individual's neutral wrist posture prior to lifting the dumbbell from a shelf.

Figure 4:
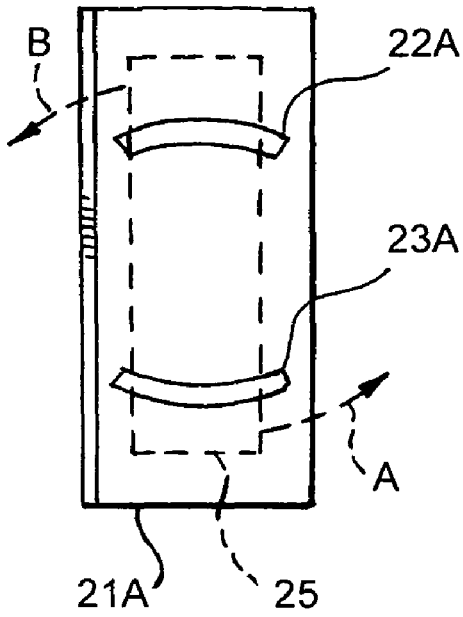
FIG. 4 is a top view illustrating the saddle of a dumbbell saddle unit constructed in accordance with one embodiment of the invention and further illustrated in FIGS. 5, 6, and 7.
Figure 5:
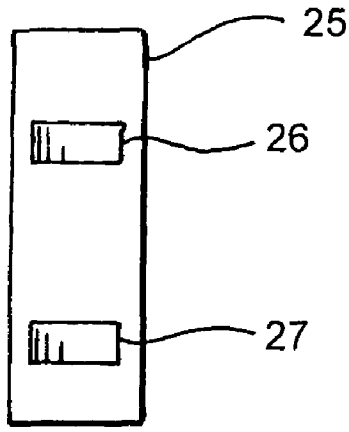
FIG. 5 is a top view illustrating the shelf of the dumbbell saddle unit of FIGS. 6 and 7 and the mode of operation thereof.
Figure 7:
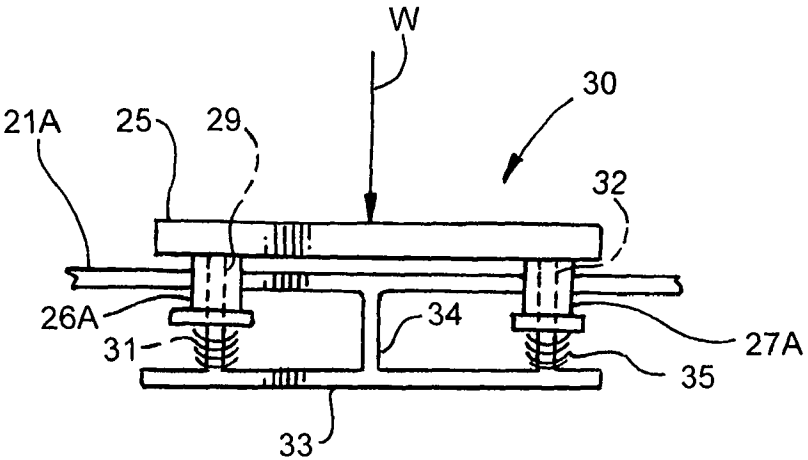
FIG. 7 is a side view illustrating the mode of operation of the dumbbell saddle unit of FIG. 6.
Figure 6:
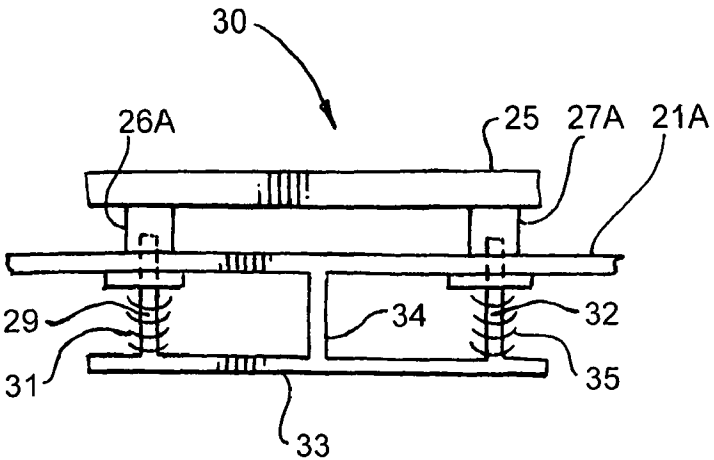
FIG. 6 is a side view illustrating a dumbbell saddle unit.

Neck 34 (FIGS. 6 and 7) is fixedly secured to the bottom of tier 21 A. Base 33 is spaced apart from and parallel to member 25 and is pivotally secured to the bottom of neck 34 such that base 33 can pivot about neck 34 in the directions of arrows A and B (FIG. 4). Feet 29 and 32 each slidably extend upwardly into an aperture formed in legs 26A and 27A, respectively. The upper end of spring 31 is secured to the bottom of leg 26A. The lower end of spring 31 is secured to base 33. The upper end of spring 35 is secured to the bottom of leg 27A. The lower end of spring 35 is secured to base 33. When a dumbbell is seated in grooves 26 and 27 and resting on member 25, the weight W of the dumbbell compresses springs 31 and 35 from the position depicted in FIG. 6 to the position illustrated in FIG. 7, causing member 25 to move closer to support tier 21A, and causing legs 26A and 27A to slide downwardly over feet 29 and 32, respectively. When the dumbbell is lifted from member 25, springs 31 and 35 expand and cause member 25 move upwardly from the position shown in FIG. 7 to return to the position illustrated in FIG. 6.

Figure 8:
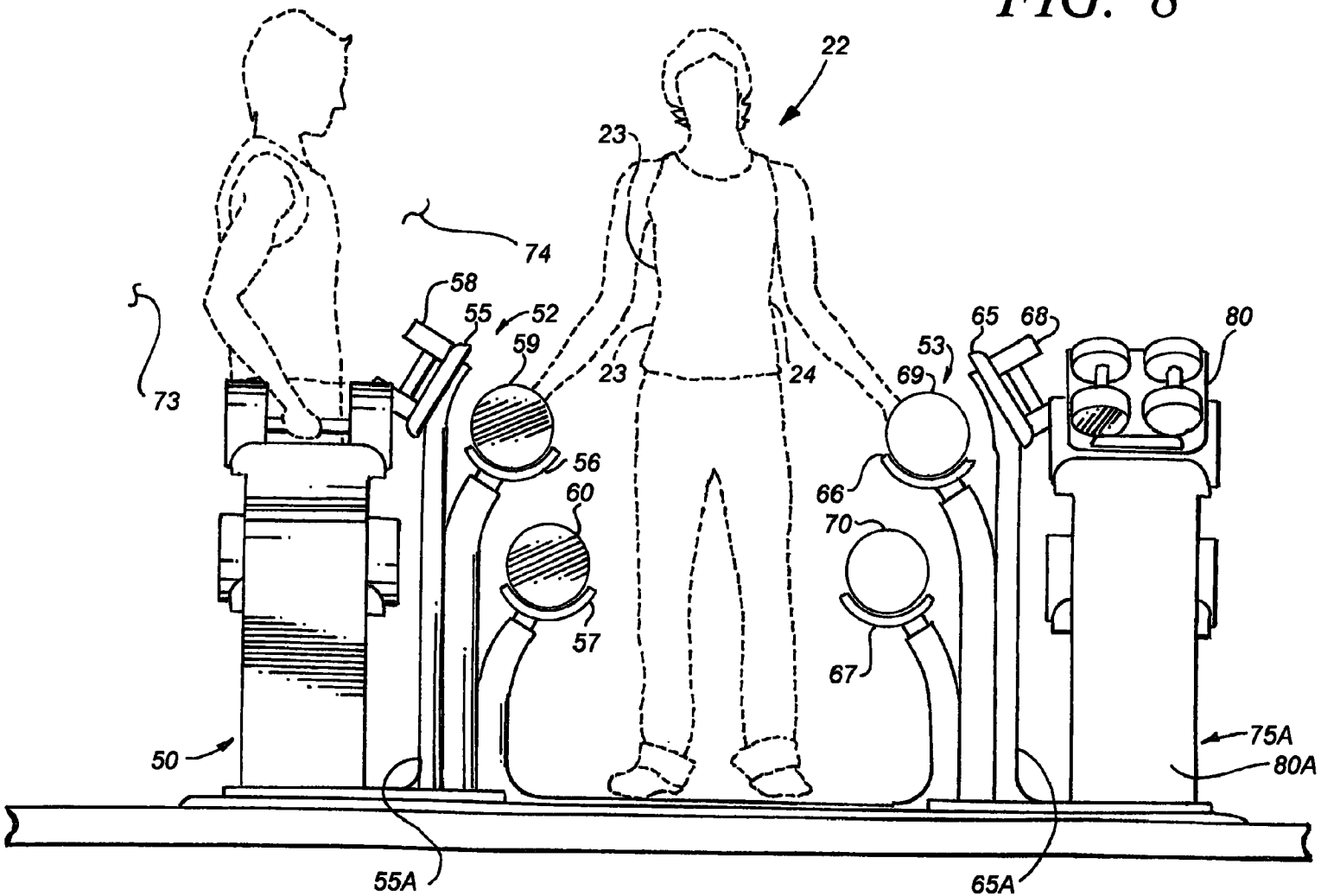
FIG. 8 is an elevation view illustrating a dumbbell rack system constructed in accordance with another embodiment of the invention.
Figure 9:
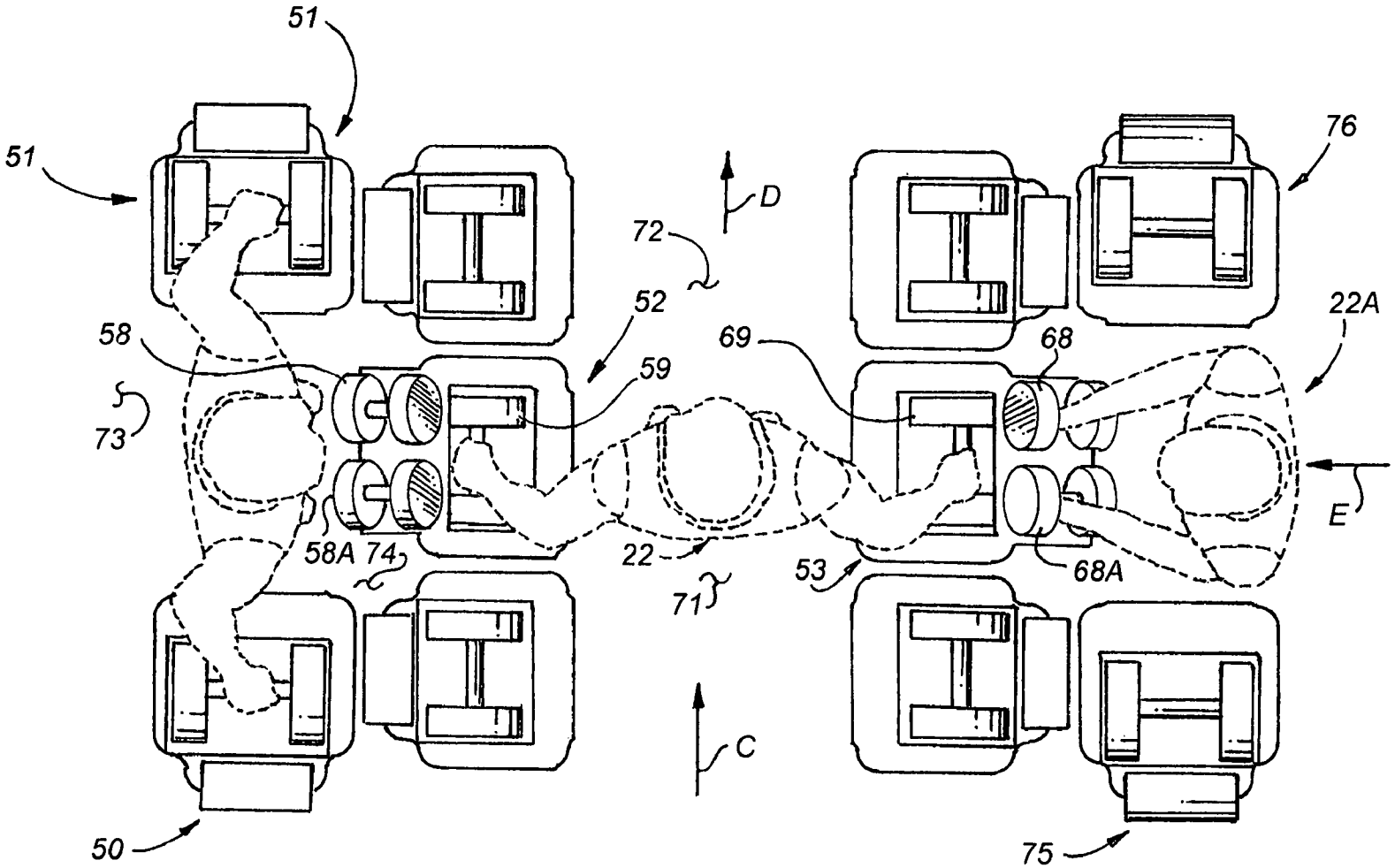
FIG. 9 is a top view of the dumbbell rack system of FIG. 8 illustrating further construction details thereof; and, FIG. 10 is a front view illustrating the power zone of individuals of various gender and height.

FIGS. 8 and 9 illustrate an alternate embodiment of the invention comprising an apparatus and method for individuals to prepare for and conduct an exercise using dumbbells while minimizing the risk of injury during the acquisition, use, and return of the dumbbells. In FIG. 8, individual 22 is facing in a direction opposite that of FIG. 9.

The apparatus of FIGS. 8 and 9 includes multiple staging stations including a first staging station comprising spaced apart towers 50 and 51, a second staging station comprising spaced apart towers 52 and 53, and a third staging station comprising spaced apart towers 75 and 76.

The second staging station is positioned in an orientation that is generally perpendicular to and intermediate the first and third staging stations.

The first staging station has a first side 73 and a second side 74. If the first staging station were utilized standing alone, an individual could enter and exit the first staging station via either side 73 and 74. In FIGS. 8 and 9, however, tower 52 of the second staging station blocks side 74 so that an individual can enter and exit the first staging station only from side 73. If the first staging station is placed against a wall, then, in a similar manner, an individual can enter and exit the first staging station from one side only.

In the second staging station, tower 53 includes fixed tiers 65, 66, and 67. Tower 52 includes fixed tiers 55, 56, 57. Dumbbells 68, 69, 70 rest on tiers 65, 66, 67, respectively. Tiers 56 and 66 are at equivalent heights above the ground. Tiers 57 and 67 are at equivalent heights above the ground. Dumbbells 58, 59, 60 rest on tiers 55, 56, 57, respectively. Dumbbells 59, 69 are equivalent in weight and shape and dimension. Dumbbells 60 and 70 are equivalent in weight and shape and dimension. Dumbbells 58 and 58A (FIG. 9) are equivalent in weight and shape and dimension. Dumbbells 68 and 68A are equivalent in weight and shape and dimension. It is possible for an individual 22 to utilize a first dumbbell of a first weight and/or shape and dimension in one hand and to utilize simultaneously in the other hand a second dumbbell having a weight or shape and dimension different from the first dumbbell. This is unusual. Dumbbells ordinarily are utilized in matched pairs. It is also, as is well known, common practice to utilize one dumbbell to perform exercises with a single arm at a time (e.g., bent over row, front and lateral deltoid raises, triceps extension, etc.).

In FIG. 9, an individual 22 has entered and walked into the second staging station (towers 52 and 53) in the direction of arrow C from first side 71. After the individual 22 grasps and removes a pair of dumbbells from towers 52 and 53, he or she walks out from and exits the staging station via side 72 in the direction of arrow D. When individual 22 is in the second staging station his sides 23 and 24 are generally parallel and adjacent to dumbbells 69, 70, 59, 60 and to the bars in said dumbbells that individual 22 grasps to hold the dumbbells. One particular advantage of the apparatus illustrated in FIGS. 8 and 9 is that while a first individual 22 is in the second staging station, a second individual 22A in the third (or first) staging station can simultaneously make use of the second staging station by grasping, removing, and utilizing dumbbells 68, 68A (or 58, 58A). Individual 22A also has the option of removing and utilizing dumbbells stored on tiers on the third staging station.

In FIGS. 8 and 9, the construction of tower 50 is, except for tier 65 and its accompanying support arm 65A, equivalent to that of tower 53; and, the construction of tower 51 is, except for tier 55 and its accompanying support arms 55A, equivalent to that of tower 52, although this need not be the case. In one embodiment of the invention, the construction of the towers 50-53 is equivalent and of towers 51-52 is equivalent while different matching pairs of dumbbells are utilized. For example, towers 50 and 51 utilize one matched pair of dumbbells that each weigh forty pounds and another matched pair of dumbbells that each weigh sixty pounds, while towers 52 and 53 utilize one matched pair of dumbbells that each weigh thirty pounds and another matched pair of dumbbells that each weight fifty pounds. In FIG. 9, the construction of tower 50 is equivalent to that of tower 76. The construction of tower 51 is equivalent to that of tower 75. In FIG. 8 a tier and support arm comparable to tier 55 and support arm 55A has been added to tower 75 to produce tower 75A. As would be appreciated by those of skill in the art, the shape and dimension of a tower 52, 53 and the tiers 66, 67, etc. in the tower can vary as desired as long as the tiers and tower carry out the function of supporting at least one dumbbell.

When an individual is standing with his or her arms hanging relaxed at his or her side, the power zone extends from his or her nipples down to the knuckles of the hands. When a dumbbell or other object grasped by a standing individual is in the power zone, the risk of injury is reduced. When the dumbbell is outside the power zone, the individual is physically in a less stable more compromised position and the risk of injury is greater. This is particularly the case as the weight of the dumbbell increases. The propensity of individual's to injury themselves while lifting objects is well documented.

One important object of the invention is to reduce the risk of injury by placing dumbbells in the power zone or by encouraging individuals to bend their knees and squat-instead of bending over and arching the back-while reaching forwardly to pick up dumbbells (or adopting numerous other awkward and taxing postures which often include twisting and asymmetric loading that increase the probability of injury). When an individual is in the first staging station (towers 50 and 51) in FIG. 9, it is difficult—if not, practically speaking impossible—for an individual 22 to bend over to grasp dumbbells that are on tiers located below the individual's waist. The individual has to bend his knees to lower his hands to reach such dumbbells. That is similarly the case in FIGS. 2 and 3 in the event the individual 22 attempts to remove, while facing wall 81, dumbbells 82 and 83. Wall 81 interferes with any significant forward bending by individual 22.

Another important object of the invention is, when desired, to enable a matching pair of dumbbells to each be placed in the power zone at or near an individual's hands while the user maintains a largely neutral posture. An overall neutral posture is specified by an individual standing erect (allowing for a slight bend in the knee), facing forward with arms hanging freely at each side and generally aligned with the frontal plane (i.e., no twisting of the trunk or other sustained innervated deviations). In this positions, the hands are said to reside at "knuckle height" which falls in the area of the quadriceps for most individuals. From this natural, stable configuration, three ergonomic benefits emerge. First, the hands are in position such that a minimal amount of movement is required to grasp and remove one or more dumbbells from its supporting tier. Second, it is more likely that the individual will retain proper upright posture, forgoing the bending movement that places significant stress on the lumbar region of the spine, and use his or her legs to support and manipulate the dumbbells' load. Third, the vertical distance is minimized between the supporting tier and a safe, intuitive carry position for the users, also reducing the work (governed by the equation Work=Force*Distance). In aggregate, these contribute significantly to a reduction in the risk of injury while dumbbells are being removed from tiers in a staging station.

Another important feature of the invention that reduces the risk of injury is the ability of an individual to walk through a dumbbell staging station instead of having to approach a dumbbell rack, grasp dumbbells, and then back away from the rack with dumbbells in hand. The walk-out capability contributes to safety by vastly improving the individual's ability to leverage his or her visual channel to continuously inspect, plan, and adapt his or her path to the area into which he or she will ambulate. It is anticipated that an individual normally will walk forwardly into and through a dumbbell station constructed in accordance with the invention. As would be appreciated by those of skill in the art, it is possible to back into a staging station and exit by walking forwardly, or, to back into one side of a staging station and to exit by backing out the other side of the staging station.

In FIG. 8, tiers 66, 67, 56, 57 are inwardly oriented because they face and open toward and are readily accessible by an individual 22 standing in the second staging station between towers 52 and 53. Tiers 55 and 65, on the other hand, are outwardly oriented because they face and open away from and are not readily accessible by an individual 22 standing in the second staging station between towers 52 and 53.

When matched dumbbell pairs 59-69 and 60-70 are in the orientation depicted in FIGS. 8 and 9, the center of gravity of each dumbbell 59, 69 60, 70 ordinarily is located in the bar on which the cylindrical weights are mounted and is located in the bar midway between the outer ends of the bar.

Figure 10:
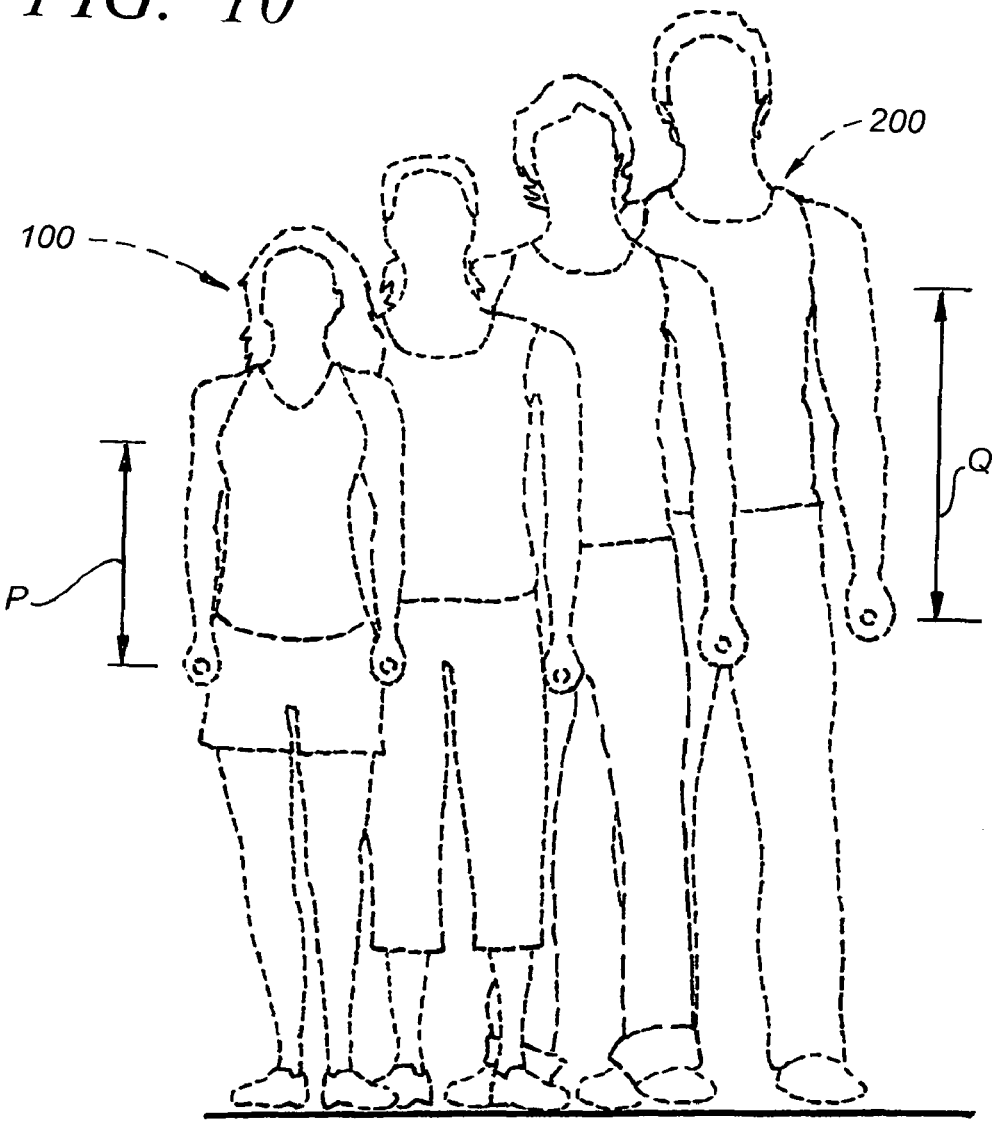

FIG. 10 illustrated the power zone, indicated by arrows P, for a woman 100 of average height (about five feet), and, the power zone, indicated by arrows Q, for a man 200 of average height (about six feet).

Having described our invention in such terms as to enable those of skill in the art to understand and practice it, and having described the presently preferred embodiments thereof, We claim:

1. An apparatus to store weights for first and second individuals to remove weights from the apparatus, minimize the risk of injury while removing the weights from the apparatus, and each remove weights from the machine at the same time the other individual removes weights from the apparatus, each of the individuals having a power zone, a neutral posture, first and second sides, and a pair of hands, the apparatus comprising (a) a first staging station including (i) a first side, (ii) a second side, (iii) a first tower including at least first and second generally horizontally oriented support tiers, said first tier at a first elevation in an inward orientation, said second tier spaced apart from said first tier and at a second elevation different from said first elevation and in an inward orientation, (iv) a second tower including at least third and fourth generally horizontally inwardly oriented support tiers, said third tier at said first elevation in an inward orientation, said fourth tier spaced apart from said third tier and at said second elevation in an inward orientation, said second tower spaced apart from said first tower such that an individual can walk from said first side to a position between said first and second towers with the individual's entire body in a space intermediate said first and second towers, the individual's first side facing said first and third tiers, and the individual's second side facing said second and fourth tiers, and access with the individual's hands said first and third tiers and said second and fourth tiers, and (v) a first plurality of dumbbells each having a center of gravity, including a first pair of dumbbells of equivalent shape, dimension, and weight, each of said first pair of dumbbells mounted on a different one of said first and third support tiers such that said center of gravity of each of said first pair of dumbbells mounted on said first and third tiers is at an elevation above the ground such that when an individual is standing between said first pair of dumbbells in a lifting position and a neutral posture, each of said first pair of dumbbells is in the power zone of the individual, and near one of the hands of the individual, and said first pair of dumbbells are generally parallel to one another, and including a second pair of dumbbells of equivalent shape, dimension, and weight, each of said second pair of dumbbells mounted on a different one of said second and fourth support tiers such that said center of gravity of each of said second pair of dumbbells mounted on said second and fourth tiers is at an elevation above the ground, and said second pair of dumbbells are generally parallel to one another; and, (b) a second staging station including (i) a primary side, (ii) a secondary side, (iii) a third tower including at least fifth and sixth generally horizontally oriented support tiers, said fifth tier at a primary elevation in an inward orientation, said sixth tier spaced apart from said fifth tier and at a secondary elevation different from said primary elevation and in an outward orientation, (iv) a fourth tower including at least a seventh generally horizontally inwardly oriented support tier, said seventh tier at said primary elevation in an inward orientation, said third tower spaced apart from said fourth tower such that an individual can walk from said primary side to a position between said third and fourth towers with the individual's entire body in a space intermediate said third and fourth towers, the individual's first side facing said fifth tier, and the individual's second side facing said seventh tier, access with the individual's hands said fifth and seventh tiers, and walk out from between said third and fourth towers to said secondary side, (v) a second plurality of dumbbells each having a center of gravity, including a third pair of dumbbells of equivalent shape, dimension, and weight, each of said third pair of dumbbells mounted on a different one of said fifth and seventh support tiers such that said center of gravity of each of said third pair dumbbells mounted on said fifth and seventh tiers is at an elevation above the ground such that when an individual is standing between said third pair of dumbbells in a lifting position and a neutral posture, each of said third pair of dumbbells is in the power zone of the individual, and near one of the hands of the individual, and said third pair of dumbbells are generally parallel to one another, and including a fourth pair of dumbbells of equivalent shape, dimension, and weight, each of said fourth pair of dumbbells mounted on said sixth tier adjacent one another;

said second staging station positioned normal to said first staging station on said second side of said first staging station such that said sixth tier is accessible to and can be reached by an individual standing in said first staging station between said first and third tiers, wherein the first individual can walk from said first side of said first staging station into said first staging station between said first and third tiers, grasp said first pair of dumbbells in the power zone of the first individual, lift said first pair of dumbbells while generally in a neutral posture; and wherein, simultaneously with the first individual walking into said first staging station, the second individual can walk into said primary side of said second staging station between said third and fourth towers and said fifth and seventh support tiers, grasp while generally in a neutral posture said third pair of dumbbells in the power zone of the second individual, lift said third pair of dumbbells, and walk out of said secondary side of said second staging station.

* * * * *